US009242487B1

(12) United States Patent
Hatada et al.

(10) Patent No.: US 9,242,487 B1
(45) Date of Patent: Jan. 26, 2016

(54) PRINTING APPARATUS

(71) Applicant: Seiko Epson Corporation, Tokyo (JP)

(72) Inventors: Kenji Hatada, Shiojiri (JP); Naohiro Ueyama, Matsumoto (JP); Ryo Hamano, Matsumoto (JP); Naoto Hayakawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/822,005

(22) Filed: Aug. 10, 2015

(30) Foreign Application Priority Data

Aug. 13, 2014 (JP) ..... 2014-164741

(51) Int. Cl.
*B41J 29/38* (2006.01)
*B41J 13/00* (2006.01)

(52) U.S. Cl.
CPC ..... *B41J 13/0009* (2013.01)

(58) Field of Classification Search
USPC ..... 347/2, 4–6, 9, 12–14, 16, 17, 19, 101, 347/104, 110, 197, 198; 400/625, 629, 636
See application file for complete search history.

(56) References Cited

U.S. PATENT DOCUMENTS 8,328,318 B2 * 12/2012 Igarashi ..... B41J 3/543 347/14
8,801,137 B2 * 8/2014 Yoshida ..... B41J 15/165 347/104
2009/0245912 A1 10/2009 Igarashi et al.
2010/0053251 A1 * 3/2010 Igarashi ..... B41J 3/543 347/16
2013/0120488 A1 * 5/2013 Horie ..... B41J 11/007 347/16
2013/0342601 A1 12/2013 Yoshida et al.
2014/0146105 A1 * 5/2014 Nakada ..... B65H 23/08 347/16
2014/0253623 A1 * 9/2014 Nakano ..... B41J 11/0045 347/16

FOREIGN PATENT DOCUMENTS

JP 2009-242048 A 10/2009
JP 2011-046172 A 3/2011
JP 2011-046518 A 3/2011
JP 2013-103834 A 5/2013
JP 2013-193307 A 9/2013
JP 2013-220884 A 10/2013
JP 2014-005108 A 1/2014

* cited by examiner

*Primary Examiner* — Kristal Feggins

(57) ABSTRACT

A printing apparatus includes a roll-out motor that rotates a roll body supported by a roll body support unit, a feed roller pair that transports a paper drawn from the roll body, and a load measuring unit that measures a rotation load of the roll body when the roll body is rotated at a low speed and a rotation load of the roll body when the roll body is rotated at a high speed. A rotation angle range in which the roll body is rotated at the high speed is greater than a rotation angle range in which the roll body is rotated at the low speed. In one rotation of the roll body, at least a part of the rotation angle range of the roll body rotated at the low speed overlaps with the rotation angle range of the roll body rotated at the high speed.

6 Claims, 8 Drawing Sheets

ROLL-OUT MOTOR
(NORMAL ROTATION)
ωH
ωL
0
ROTATION SPEED
(REVERSE ROTATION)

FEED MOTOR
(NORMAL ROTATION)
0
ROTATION SPEED
(REVERSE ROTATION)

LARGE
AMOUNT OF SLACK
SMALL
0
t1
t2
t3
t4
t5
t6
t7
t8
t9
t10
TIME

PRINTING APPARATUS

BACKGROUND

1. Technical Field

The present invention relates to a printing apparatus that performs printing on a print medium drawn from a roll body having an elongated shape.

2. Related Art

In a printing apparatus in which a roll body where a print medium such as a long paper sheet is lap-wound is loaded, a feed roller pair pinches the print medium and rotates, so that the roll body is driven to be rotated, and the print medium is drawn from the roll body. In this case, a new roll body is heavy for a while after the new roll body is loaded, so that a large force by which the feed roller pair draws the print medium from the roll body is applied to the print medium as a pulling force, and thus there is a risk that the print medium is broken.

Therefore, an ordinary printing apparatus has a roll-out motor that drives and rotates the roll body in addition to a feed motor that drives and rotates the feed roller pair. Further, the ordinary printing apparatus controls the drive of the roll-out motor and the feed motor so as to be able to draw the print medium from the roll body while suppressing the force by which the feed roller pair draws the print medium from the roll body (for example, see JP-A-2014-5108).

As the print medium is drawn from the roll body, the radius of the roll body decreases and the rotation load (torque) of the roll body decreases. Therefore, when the roll-out motor rotates the roll body by a constant driving force, as the radius of the roll body decreases, the rotation speed of the roll body increases and there is a risk that the print medium is slackened between the roll body and the feed roller pair in a transport path of the print medium.

Therefore, the printing apparatus of JP-A-2014-5108 performs measurement processing which measures a relationship between the rotation load applied to the roll-out motor when the roll-out motor is driven and the print medium is drawn from the roll body while the feed motor is stopped and the rotation speed of the roll-out motor in order to constantly apply a predetermined tensile force to the print medium drawn from the roll body. Then, the printing apparatus of JP-A-2014-5108 performs control in which variation of the rotation load applied to the roll-out motor, which is caused by change of the rotation load of the roll body, is suppressed by using a measurement value (for example, a motor instruction value) obtained by the measurement processing.

By the way, in the measurement processing, the printing apparatus of JP-A-2014-5108 measures the relationship between the rotation load applied to the roll-out motor from the roll body and the rotation speed of the roll-out motor by rotating the roll body by one turn in each of a low speed mode and a high speed mode of the roll-out motor. Therefore, the measurement processing takes a long time.

SUMMARY

An advantage of some aspects of the invention is to provide a printing apparatus that can reduce the time of the measurement processing.

Hereinafter, means for solving the above problem and its functions and effects will be described.

A printing apparatus that solves the above problem includes a roll body support unit that supports a roll body formed by lap-winding a print medium, a drive unit that rotates the roll body supported by the roll body support unit, and a load measuring unit that measures a change of a rotation load of the roll body when the roll body is rotated at a first rotation speed and a change of a rotation load of the roll body when the roll body is rotated at a second rotation speed different from the first rotation speed. Further, a rotation angle range of the roll body rotated at the second rotation speed is greater than a rotation angle range of the roll body rotated at the first rotation speed, and at least a part of the rotation angle range of the roll body rotated at the first rotation speed overlaps with the rotation angle range of the roll body rotated at the second rotation speed.

The rotation load of the roll body during one rotation varies in the same manner according to the rotation angle of the roll body even when the rotation speed of the roll body varies.

Therefore, it is possible to estimate the change of the rotation load of the roll body rotated at the first rotation speed in the rotation angle range of the roll body rotated at the second rotation speed based on the change of the rotation load in an area where the rotation angle range of the roll body rotated at the first rotation speed and the rotation angle range of the roll body rotated at the second rotation speed overlap with each other. Therefore, even when the rotation angle range of the roll body rotated at the first rotation speed is smaller than the rotation angle range of the roll body rotated at the second rotation speed, it is possible to grasp the change of the rotation load of the roll body in the same rotation angle range as the rotation angle range of the second rotation speed. Therefore, for example, when the roll body is rotated by one turn at the second rotation speed, even if the roll body is rotated by less than one turn at the first rotation speed, it is possible to grasp the rotation load of the roll body in a period in which the roll body is rotated by one turn at the first rotation speed. Therefore, it is possible to reduce the processing time of the measurement processing as compared with the measurement processing of an ordinary printing device.

In the printing apparatus described above, it is preferable that the second rotation speed is faster than the first rotation speed.

According to this configuration, it is possible to further reduce the measurement time of the rotation load of the roll body rotated at the second rotation speed by increasing the second rotation speed where the rotation angle range of the roll body is large. Therefore, it is possible to further reduce the processing time of the measurement processing.

In the printing apparatus described above, it is preferable that the load measuring unit measures a change of the rotation load of the roll body over one rotation of the roll body rotated at the second rotation speed.

When measuring a change of the rotation load of the roll body rotated by less than one turn at the second rotation speed, there is a rotation angle range in which the rotation load of the roll body is not measured, so that it is not possible to accurately grasp the change of the rotation load of the roll body. On the other hand, according to the present printing apparatus, a change of the rotation load of the roll body rotated by one turn at the second rotation speed is measured, so that there is no rotation angle range in which the rotation load of the roll body is not measured. Therefore, it is possible to accurately grasp the change of the rotation load of the roll body. Therefore, it is possible to accurately adjust the tensile force of the print medium drawn from the roll body to a predetermined value that is set in advance.

In the printing apparatus described above, it is preferable that the load measuring unit measures a change of the rotation load of the roll body over a quarter rotation of the roll body rotated at the first rotation speed.

In the printing apparatus described above, it is preferable that the first rotation speed is a slowest speed during printing of the print medium and the second rotation speed is a fastest speed during printing of the print medium.

According to this configuration, it is possible to obtain a relationship between the rotation speed of the roll body and the rotation load of the roll body in a largest speed range during printing to the print medium. Therefore, it is possible to accurately grasp the relationship between the rotation speed of the roll body and the rotation load of the roll body. Therefore, it is possible to accurately control the drive unit based on the obtained relationship.

In the printing apparatus described above, it is preferable that the printing apparatus includes a slack detection unit that detects a slack state of the print medium drawn from the roll body.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of a printing apparatus will be described with reference to the drawings. The printing apparatus of the embodiment is, for example, an ink jet type printer that performs printing by ejecting ink, which is an example of liquid, to a medium. The printer is a so-called serial type printer whose printing method performs printing by moving a print head in a direction perpendicular to a transport direction of a medium.

Figure 1:
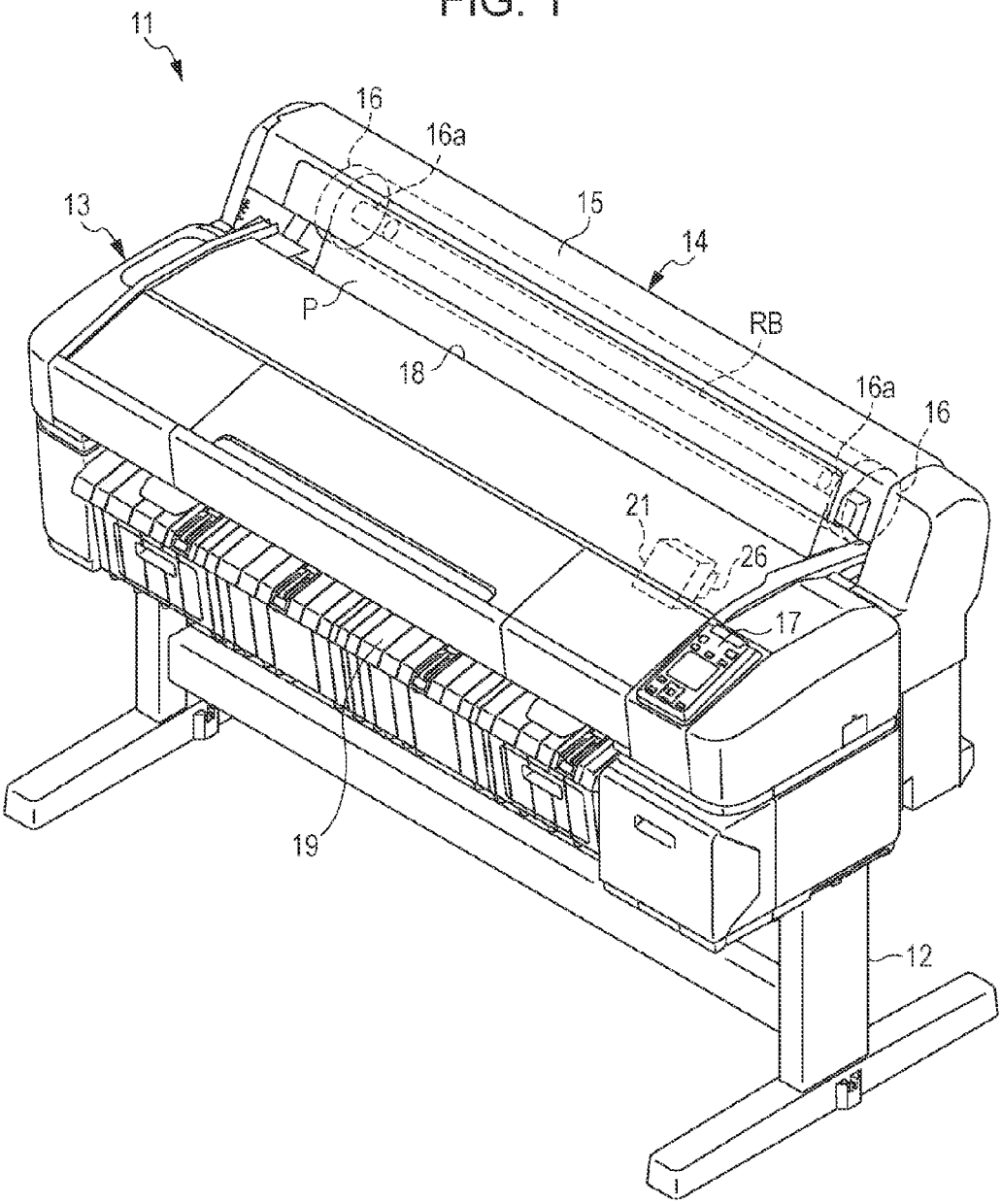
FIG. 1 is a perspective view of a printing apparatus of an embodiment.

As shown in FIG. 1, a printing apparatus 11 includes an apparatus main body 13 having an approximately rectangular parallelepiped shape which is supported by a pedestal 12 and a paper feed unit 14 provided so as to protrude diagonally upward and rearward from the rear of the apparatus main body 13.

The paper feed unit 14 includes a flip-up opening/closing cover 15. In the paper feed unit 14, a roll body RB formed by lap-winding a long paper sheet, which is an example of the print medium, in a roll shape is loaded by opening the opening/closing cover 15. The roll body RB is supported by a pair of roll body support units 16 provided at positions corresponding to both ends in the longitudinal direction of the roll body RB in the paper feed unit 14. A protrusion portion 16*a* provided at the center of the roll body support unit 16 is fitted into a hollow portion of the roll body RB, and thereby the roll body support unit 16 supports the roll body RB.

Figure 2:
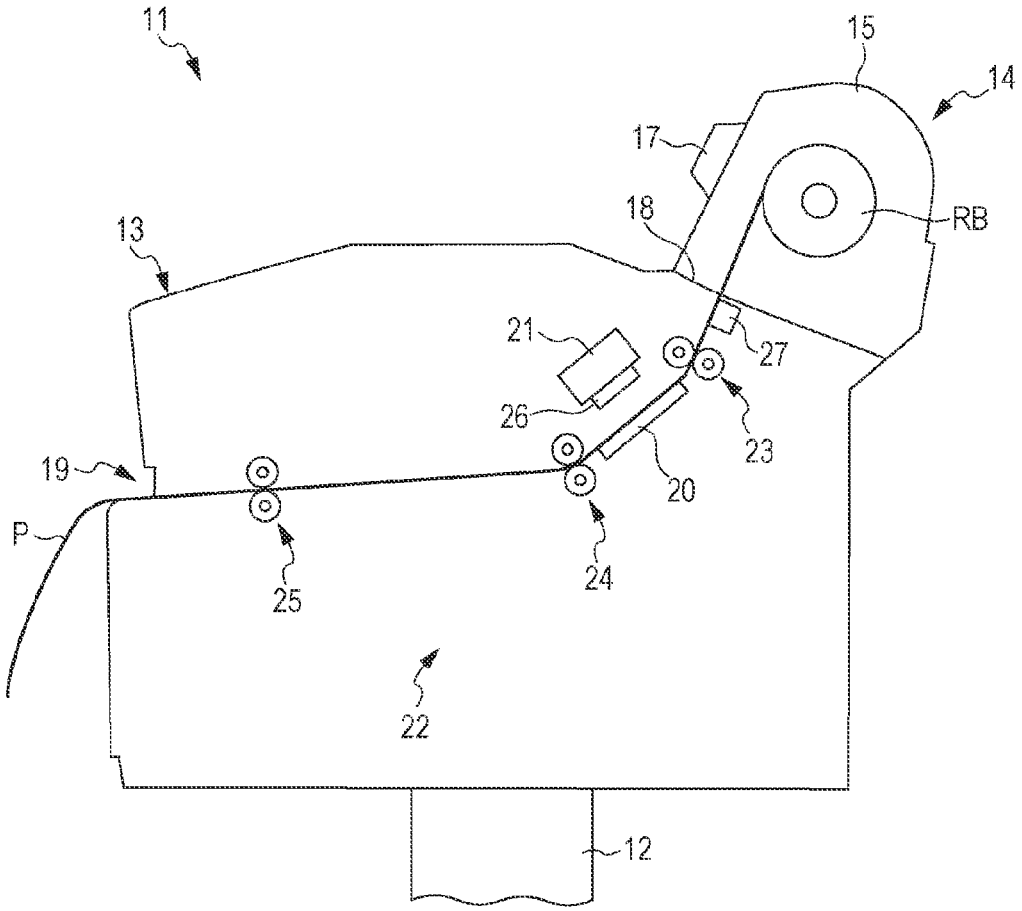
FIG. 2 is a schematic configuration diagram showing an internal configuration of the printing apparatus of the embodiment.

An operation unit 17 for a user to operate the printing apparatus 11 is provided at the front right of the apparatus main body 13. As shown in FIG. 2, the apparatus main body 13 houses a support table 20 that supports a paper P, a printing unit 21 that performs printing on the paper P supported by the support table 20, and a transport mechanism 22 that transports the paper P from a paper feed port 18 formed at a boundary portion between the apparatus main body 13 and the paper feed unit 14 to a paper discharge port 19 formed at a front portion of the apparatus main body 13.

In the transport mechanism 22, from the upstream side to the downstream side of the transport path of the paper P, a feed roller pair 23, a sending roller pair 24, and a paper discharge roller pair 25 are arranged in this order in the transport path at appropriate intervals. Each roller pair 23 to 25 pinches the paper P by a drive roller and a driven roller, and each roller can rotate around an axis extending in a paper width direction (in FIG. 2, a direction perpendicular to the page) perpendicular to the transport direction of the paper P. A plurality of drive rollers and a plurality of driven rollers of the feed roller pair 23 are provided separately in the paper width direction (see FIG. 3).

The support table 20 is arranged between the feed roller pair 23 and the sending roller pair 24 in the transport path. A suction fan (not shown in the drawings) is built into the support table 20. The paper P transported onto the support table is sucked to a support surface of the paper P of the support table 20 by rotational drive of the suction fun through a plurality of suction holes (not shown in the drawings) formed in the support surface.

The printing unit 21 is arranged movably in a main scanning direction, which is a direction along the paper width direction, at a position facing the support table 20 with the transport path of the paper P in between. The printing unit 21 includes a print head 26 that performs printing by ejecting ink from a plurality of nozzles (not shown in the drawings) to the paper P transported onto the support table 20.

A slack detection unit 27 that detects slack of the paper P drawn from the roll body RB is arranged between the roll body RB and the feed roller pair 23 in the transport path. The slack detection unit 27 is a contact type lever switch. When the amount of slack of the paper P becomes greater than or equal to a threshold value, a lever is actuated and the slack detection unit 27 detects the slack of the paper P. The threshold value is the amount of slack when excessive variation occurs in the length of transport of the paper P by the feed roller pair 23 due to the slack of the paper P. The threshold value is set in advance by test and the like.

Figure 3:
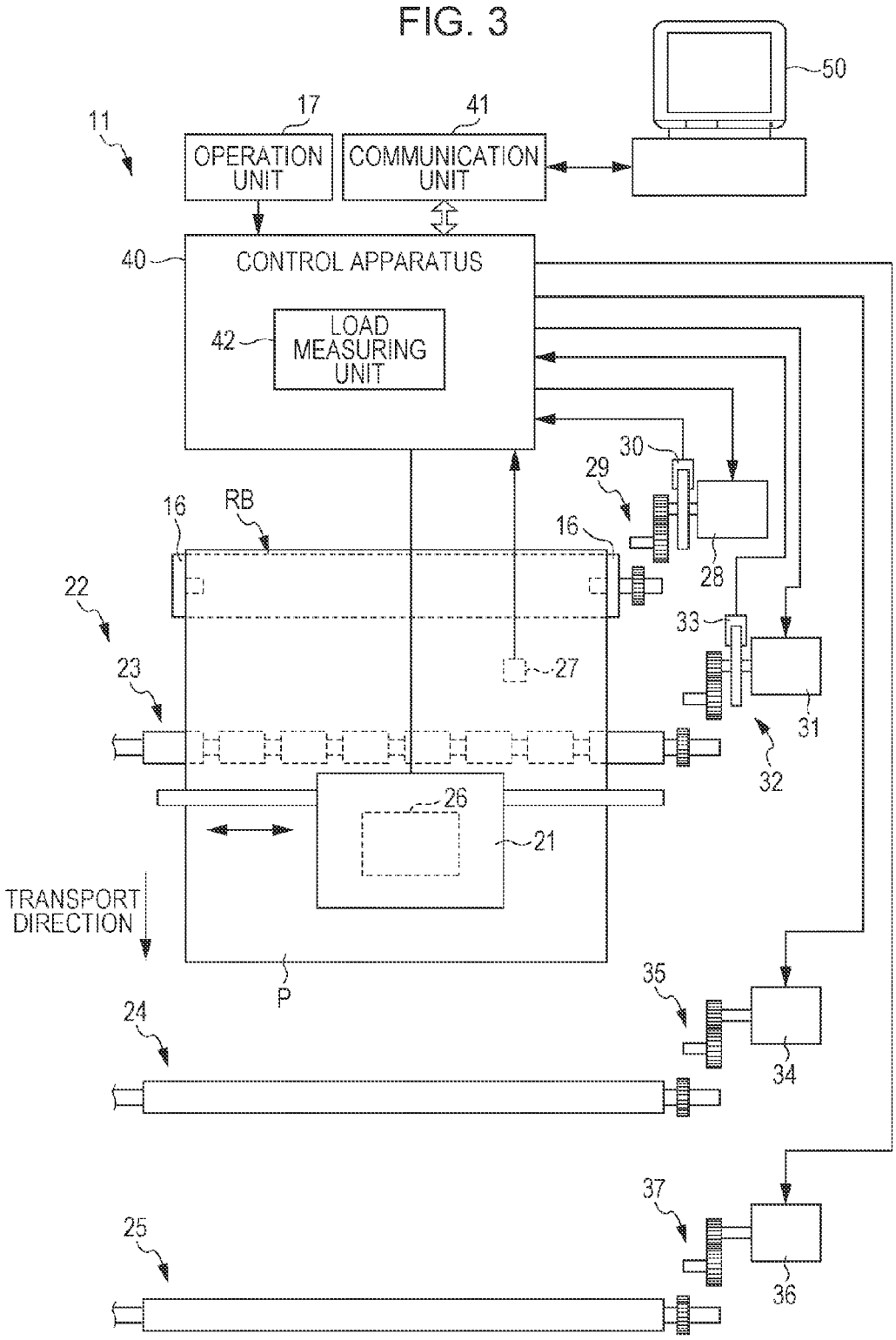
FIG. 3 is a schematic diagram showing an electrical configuration of the printing apparatus of the embodiment.

As shown in FIG. 3, the roll body support unit 16 is drivably connected to a roll-out motor 28, which is an example of a drive unit that rotates the roll body RB supported by the roll body support unit 16, through a speed reduction mechanism 29. A roll-out encoder 30 that detects a rotation speed of an output shaft of the roll-out motor 28 is attached to the output shaft.

A feed motor 31 that rotates the drive roller of the feed roller pair 23 is drivably attached to the drive roller through a speed reduction mechanism 32. A feed encoder 33 that detects a rotation speed of an output shaft of the feed motor 31 is attached to the output shaft.

A sending motor 34 that rotates the drive roller of the sending roller pair 24 is drivably attached to the drive roller through a speed reduction mechanism 35.

A paper discharge motor 36 that rotates the drive roller of the paper discharge roller pair 25 is drivably attached to the drive roller through a speed reduction mechanism 37. Regarding each speed reduction mechanism 29, 32, 35, and 37 in FIG. 3, a gear of the drive roller does not engage with another gear. However, in practice, the gear of the drive roller engages with another gear through at least one gear not shown in FIG. 3.

The printing apparatus 11 includes a control apparatus 40 that controls the printing unit 21 and the transport mechanism 22. The control apparatus 40 is provided with a communication unit 41 that can communicate with an external device 50 such as a host computer. The control apparatus 40 controls the transport of the paper P performed by the roll-out motor 28, the feed motor 31, the sending motor 34, and the paper discharge motor 36, the movement of the print head 26 in the main scanning direction, and the ejection of ink based on operation information from the operation unit 17 and print information transmitted from the external device 50.

The control apparatus 40 has a high-speed print mode and a high-quality print mode as a print mode. When the print mode is the high-speed print mode, the control apparatus 40 controls the roll-out motor 28, the feed motor 31, the sending motor 34, and the paper discharge motor 36 so that the paper P is transported at high speed. When the print mode is the high-quality print mode, the control apparatus 40 controls the roll-out motor 28, the feed motor 31, the sending motor 34, and the paper discharge motor 36 so that the paper P is transported at low speed.

The control apparatus 40 receives a signal corresponding to the rotation speed of the roll-out motor 28 detected by the roll-out encoder 30 and a signal corresponding to the rotation speed of the feed motor 31 detected by the feed encoder 33 at a predetermined sampling cycle. The control apparatus 40 performs PWM control through PID control so that an actual rotation speed of the roll-out motor 28 detected by the roll-out encoder 30 becomes a target roll-out speed. Specifically, the control apparatus 40 calculates a proportional control value Qp(j), an integral control value Qi(j), and a differential control value Qd(j) of the PID control from a speed deviation Δω between the actual rotation speed of the roll-out motor 28 and the target roll-out speed as shown by the following expressions (1) to (3).

$$Qp(j)=\Delta\omega(j)\times Kp \quad (1)$$

$$Qi(j)=Qi(j-1)+\Delta\omega(j)\times Ki \quad (2)$$

$$Qd(j)=\{\Delta\omega(j)-\Delta\omega(j-1)\}\times Kd \quad (3)$$

Here, "j" is time, "Kp" is a proportional gain, "Ki" is an integration gain, and "Kd" is a derivative gain.

Specifically, the control apparatus 40 calculates a control value Qpid by summing the proportional control value Qp(j), the integral control value Qi(j), and the differential control value Qd(j), and calculates a DUTY value corresponding to the control value Qpid. Then, the control apparatus 40 drives the roll-out motor 28 based on the DUTY value.

Further, in the same manner as the control of the roll-out motor 28, the control apparatus 40 performs PWM control through PID control so that an actual rotation speed of the feed motor 31 detected by the feed encoder 33 becomes a target feed speed. The target roll-out speed and the target feed speed are stored in a memory (not shown in the drawings) of the control apparatus 40 in advance.

The control apparatus 40 further includes a load measuring unit 42 that measures a change of the rotation load applied to the roll-out motor 28 as a change of the rotation load of the roll body RB. The control apparatus 40 performs measurement processing that obtains a relationship between the rotation load of the roll body RB and the rotation speed of the roll body RB after the roll body RB is set in the paper feed unit 14 and before starting printing on the paper P by using the load measuring unit 42. The control apparatus 40 obtains a relationship between the rotation load of the roll-out motor 28 as the rotation load of the roll body RB and the rotation speed of the roll-out motor 28 to cause the rotation speed of the roll body RB to be a certain rotation speed as the measurement processing. Based on a result of the measurement processing, the control apparatus 40 controls the drive of the roll-out motor 28 and the feed motor 31 so that a predetermined tensile force is applied to the paper P drawn from the roll body RB by considering the change of the rotation load of the roll-out motor 28 based on a change of the remaining amount of the paper P of the roll body RB.

Next, details of the measurement processing will be described with reference to FIGS. 4 to 7. In the description below, a direction in which the roll body RB rotates so that the paper P is transported to the downstream side of the transport path is defined as "normal rotation" and a direction in which the roll body RB rotates so that the paper P is transported to the upstream side of the transport path is defined as "reverse rotation". Each component of the printing apparatus 11 denoted by a reference numeral in the description below indicates each component of the printing apparatus 11 described in FIGS. 1 to 3.

In the measurement processing, the control apparatus 40 obtains a relationship between the rotation load of the roll body RB and the rotation speed of the roll body RB by measuring the rotation load of the roll body RB when the roll body RB normally rotates at a low speed that is an example of a first rotation speed and the rotation load of the roll body RB when the roll body RB normally rotates at a high speed that is an example of a second rotation speed. In other words, the control apparatus 40 measures a rotation load TiL of the roll-out motor 28 when the roll-out motor 28 is driven at a low speed ωL so that the roll body RB is normally rotated at the low speed (the first rotation speed) and a rotation load TiH of the roll-out motor 28 when the roll-out motor 28 is driven at a high speed ωH so that the roll body RB is normally rotated at the high speed (the second rotation speed). These rotation loads TiH and TiL are calculated as average values aveTiH and aveTiL of the integral control values Qi(j) of the roll-out motor 28. Thereby, the control apparatus 40 obtains relationships between the rotation loads TiH, TiL of the roll-out motor 28 and the rotation speeds ωL, ωH of the roll-out motor 28 (hereinafter referred to as "load-speed relationship"). The rotation speed ωH (high speed) of the roll-out motor 28 corresponds to the rotation speed of the roll-out motor 28 when the print mode is the high-speed print mode, that is, a highest rotation speed when the printing apparatus 11 performs printing. The rotation speed ωL (low speed) of the roll-out motor 28 corresponds to the rotation speed of the roll-out motor 28 when the print mode is the high-quality print mode, that is, a slowest rotation speed when the printing apparatus 11 performs printing.

Figure 4:
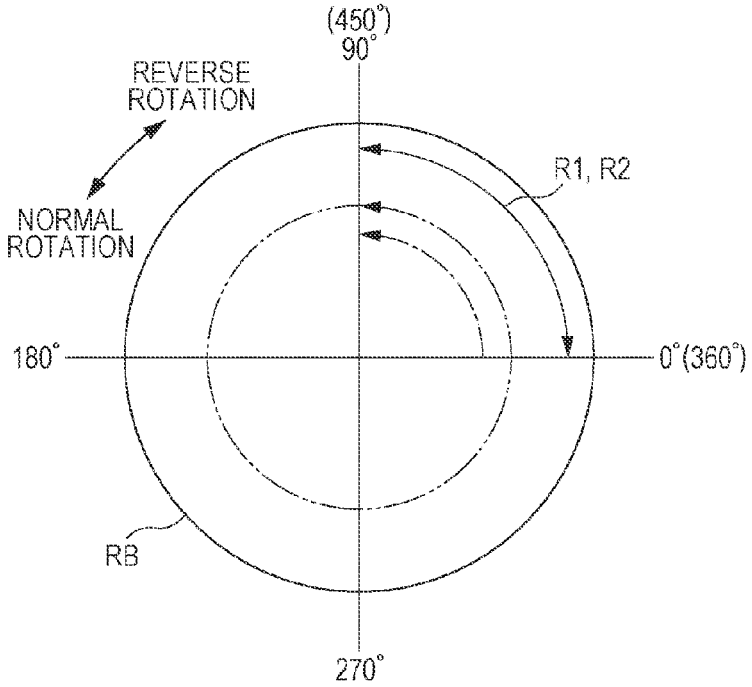
FIG. 4 is a schematic diagram for explaining a rotation angle range of a roll body in measurement processing.
Figure 5:
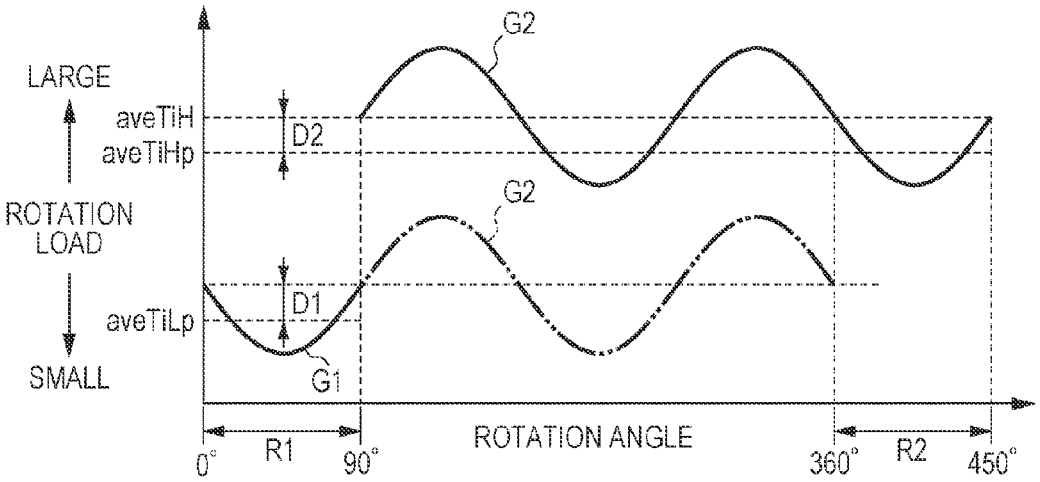
FIG. 5 is a graph showing a relationship between a rotation load of a roll-out motor and a rotation angle of the roll body.

As shown by a dashed-dotted line in FIG. 4, the control apparatus 40 measures the rotation loads TiL over a period of time in which the roll-out motor 28 rotates the roll body RB by a quarter turn while the roll-out motor 28 is in a state of low speed ωL, and calculates an average value aveTiLp of the rotation loads TiL. At this time, the rotation load TiL varies according to a rotation angle of the roll body RB as shown by, for example, a graph G1 in FIG. 5.

As shown by a dashed-two-dotted line in FIG. 4, the control apparatus 40 measures the rotation loads TiH over a period of time in which the roll-out motor 28 rotates the roll body RB by one turn while the roll-out motor 28 is in a state of high speed ωH after the roll body RB rotates by a quarter turn, and calculates an average value aveTiH of the rotation loads TiH. At this time, the rotation load TiH is greater than the rotation load TiL and varies according to a rotation angle of the roll body RB as shown by, for example, a graph G2 in FIG. 5.

As shown in FIG. 4, in a rotation angle range (90° to 450°) in which the roll-out motor 28 rotates the roll body RB while the roll-out motor 28 is in the state of high speed ωH, there is an rotation angle range R2 (360°≤R2≤450°) that overlaps with a rotation angle range R1 (0°≤R1≤90°) in which the roll-out motor 28 rotates the roll body RB while the roll-out motor 28 is in the state of low speed ωL. As shown by the graphs G1 and G2 in FIG. 5, a variation mode of the rotation load TiL in the rotation angle range R1 is substantially the same as a variation mode of the rotation load TiH in the rotation angle range R2. Therefore, it can be estimated that a variation mode of the rotation load TiL when the roll-out motor 28 rotates the roll body RB by one turn at the low speed ωL is substantially the same as a variation mode of the rotation load TiH when the roll-out motor 28 rotates the roll body RB by one turn at the high speed ωH. Therefore, it can be estimated that a variation mode of the rotation load TiL when the roll-out motor 28 rotates the roll body RB by ¾ turns at the low speed ωL is as shown by the graph G1 in FIG. 5.

Therefore, a difference D2 between an average value aveTiHp of the rotation loads TiH in the rotation angle range R2 and an average value aveTiH of the rotation loads TiH when the roll body RB is rotated by one turn is the same as a difference D1 between an average value aveTiLp of the rotation loads TiL in the rotation angle range R1 and an average value aveTiL of the rotation loads TiL when the roll body RB is rotated by one turn.

Therefore, the control apparatus 40 calculates the average value aveTiH of the rotation loads TiH when the roll body RB is rotated by one turn based on the average value aveTiHp of the rotation loads TiH measured in the rotation angle range R2 and the average value aveTiH of the rotation loads TiH when the roll body RB is rotated by one turn. Then, the control apparatus 40 calculates the average value aveTiL of the rotation loads TiL in a period while the roll-out motor 28 is in the state of low speed ωL based on the following expression.

$$aveTiL = aveTiLp + (aveTiH - aveTiHp) \quad (4)$$

Figure 6:
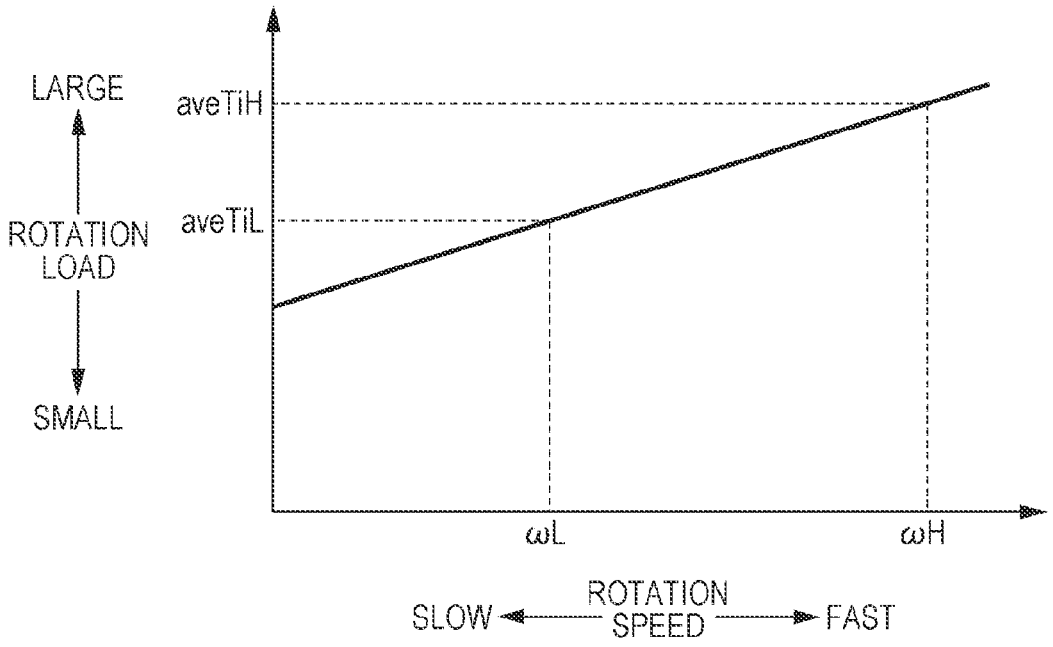
FIG. 6 is a graph showing a relationship between the rotation load of the roll-out motor and a rotation speed of the roll-out motor.
Figure 7:
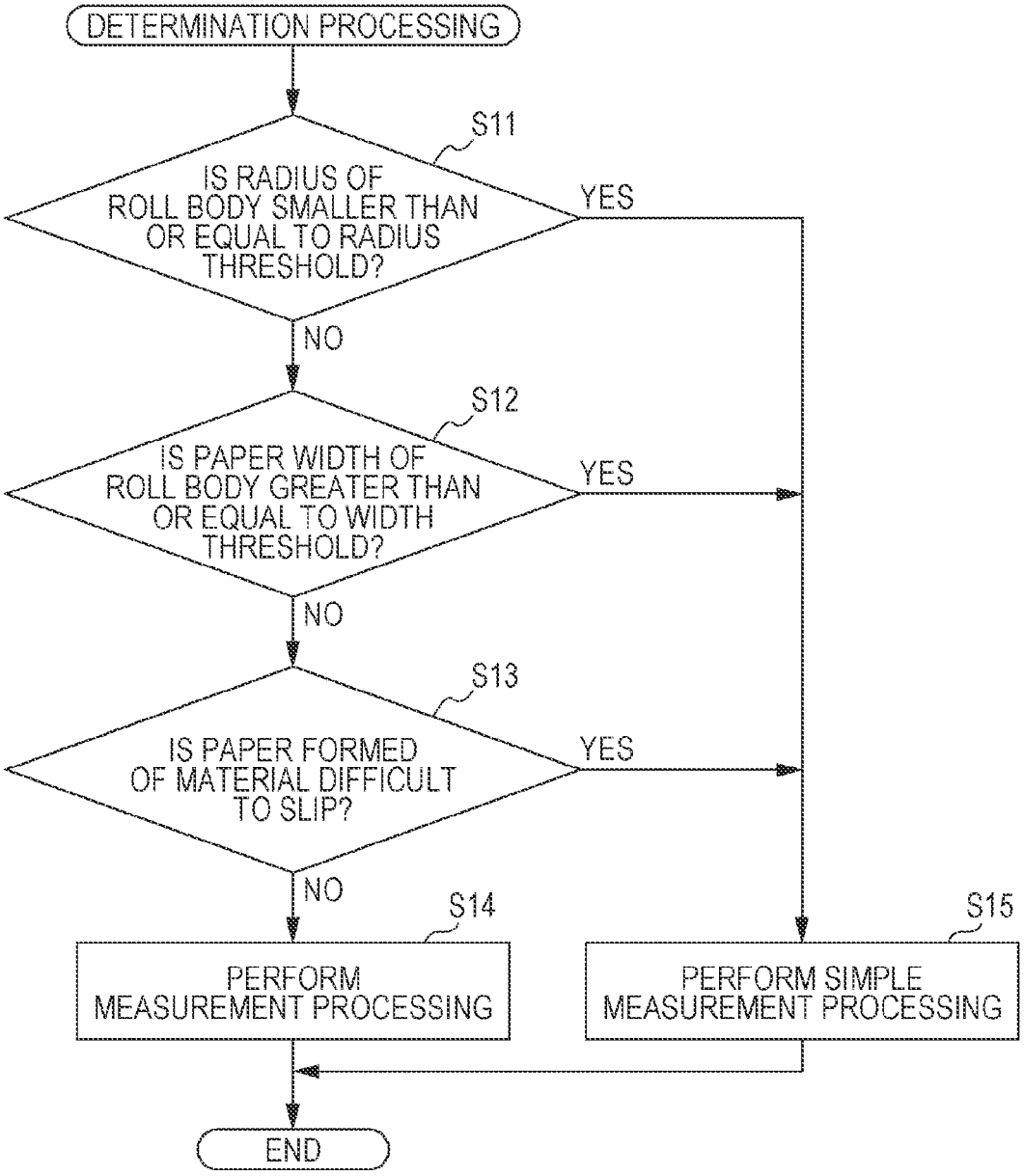
FIG. 7 is a flowchart showing a procedure of determination processing performed by a control apparatus.

Then, the control apparatus 40 obtains the load-speed relationship, which is a linear function shown in FIG. 6, based on the average value aveTiL of the rotation loads TiL when the roll-out motor 28 rotates the roll body RB by one turn at the low speed ωL and the average value aveTiH of the rotation loads TiH when the roll-out motor 28 rotates the roll body RB by one turn at the high speed ωH.

The control apparatus 40 calculates a DUTY value Dn required to drive the roll-out motor 28 at a predetermined speed ωn based on the expression described below from the load-speed relationship obtained in the measurement processing as described above. The predetermined speed ωn corresponds to the target roll-out speed.

$$Dn = a\omega n + b \quad (5)$$

In the above expression (5), "a" of the linear function of the load-speed relationship indicates the slope of the linear function and "b" indicates the intercept of the linear function, so that "a" and "b" are calculated as follows.

$$a = (aveTiH - aveTiL)/(\omega H - \omega L)$$

$$b = aveTiL - (aveTiH - aveTiL) \times \omega L/(\omega H - \omega L)$$

By the way, when the paper P is transported, if the paper P is slackened, variation occurs in the length of transport of the paper P transported from the feed roller pair 23 to the support table 20. Therefore, it is preferable that the paper P is transported with a certain level of tensile force so that the paper P does not slacken.

Therefore, the control apparatus 40 calculates a DUTY value Df of the roll-out motor 28 as follows so that the paper P is transported with a predetermined tensile force F.

$$Df = (F \times r/M) \times D\max/Ts \quad (6)$$

Here, "r" indicates the radius of the roll body RB, "Dmax" indicates the maximum value of the DUTY value of the roll-out motor 28, and "Ts" indicates a starting torque of the roll-out motor 28. The radius r of the roll body RB can be estimated from, for example, the number of rotations of the roll-out motor 28 detected by the roll-out encoder 30.

The control apparatus 40 calculates a DUTY value Dx of the roll-out motor 28 as follows when the roll-out motor is driven at the predetermined speed ωn while the predetermined tensile force F is applied to the paper P.

$$Dx = Dn - Dt \quad (7)$$

The control apparatus 40 drives the roll-out motor 28 with the DUTY value Dx, and thereby can transport the paper P by reducing influence of variation of the rotation load accompanying change of weight of the roll body RB.

By the way, there is a case in which the rotation load of the roll body RB is difficult to be changed by the rotation of the roll body RB depending on the weight or the like of the roll body RB. In this case, in the measurement processing, it is possible to accurately measure the rotation load of the roll body RB (the rotation load of the roll-out motor 28) without measuring the rotation load over one rotation of the roll body RB.

Therefore, the control apparatus 40 performs determination processing that determines whether or not to perform the measurement processing after the roll body RB is set in the paper feed unit 14. The procedure of the determination processing will be described with reference to a flowchart in FIG. 7.

The control apparatus 40 determines whether or not to perform the measurement processing based on three conditions described below. (a) The radius of the roll body RB is greater than or equal to a radius threshold (step S11). (b) The paper width of the roll body RB is greater than or equal to a width threshold (step S12). (c) The paper P is formed of a material difficult to slip (step S13).

Here, the radius threshold is a radius of the roll body RB, where the rotation load of the roll body RB (the rotation load of the roll-out motor 28) becomes smaller than or equal to a predetermined value, and is set in advance by test or the like.

The width threshold is a paper width, where a predetermined number of feed roller pairs 23 of a plurality of feed roller pairs 23 arranged separately in the paper width direction in the printing apparatus 11 can pinch the paper P, and is set in advance. The material difficult to slip is a material of the paper P, which is restrained from slipping with respect to each roller of the feed roller pairs 23 when the paper P is pinched by the feed roller pairs 23. For example, the material of the paper P is a plain paper which is a non-glossy paper.

When all the conditions of steps S11 to S13 are not satisfied, the control apparatus 40 performs the measurement processing in step S14. On the other hand, when any one of the conditions of steps S11 to S13 is satisfied, the control apparatus 40 performs simple measurement processing in step S15 instead of the measurement processing.

A rotation angle range of the roll body RB is different between the simple measurement processing and the measurement processing described above. Specifically, in the simple measurement processing, the control apparatus 40 rotates the roll body RB by a ⅓ turn while the roll-out motor 28 is in the state of low speed ωL and rotates the roll body RB by a ⅓ turn while the roll-out motor 28 is in the state of high speed ωH. Then, the control apparatus 40 calculates an average value aveTiL of the rotation loads TiL and an average value aveTiH of the rotation loads TiH while the roll body RB rotates by a ⅓ turn. Thereby, the control apparatus 40 obtains the load-speed relationship. Thereafter, the control apparatus 40 calculates the DUTY value Dx of the roll-out motor 28 in the same manner as in the measurement processing. In this manner, the processing time of the simple measurement processing is shorter than that of the measurement processing because the amount of rotation of the roll body RB required to obtain the load-speed relationship is small in the simple measurement processing.

Operations and effects of the printing apparatus 11 of the embodiment before starting printing will be described with reference to FIGS. 8A to 9C. Each component of the printing apparatus 11 denoted by a reference numeral in the description below indicates each component of the printing apparatus 11 described in FIG. 3, 9A, 9B, or 9C.

The printing apparatus 11 performs the measurement processing, slack removal processing, and tensile force adjustment processing in this order as operations before starting printing. The slack removal processing is processing that removes slack of the paper P generated by the measurement processing. The tensile force adjustment processing is processing that controls the roll-out motor 28 and the feed motor 31 so that the tensile force of the paper P is a predetermined tensile force F. The tensile force F is set in advance based on the radius of the roll body RB, the paper width of the paper P, and the material of the paper P. It is possible for a user to change the magnitude of the tensile force F by operating the operation unit 17.

Figure 9A:
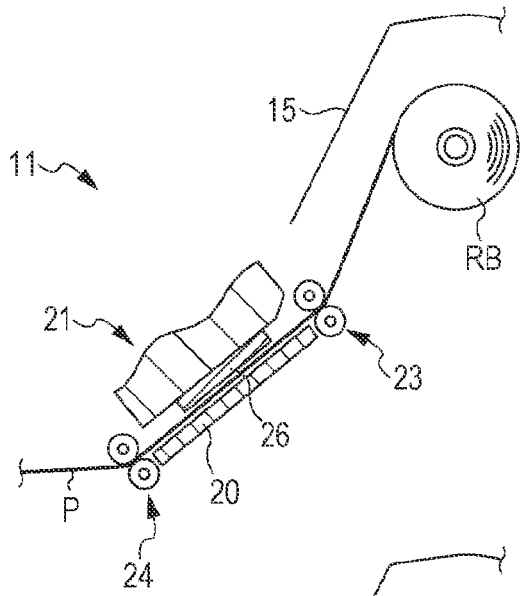
FIG. 9A is a schematic diagram showing a state of paper of the roll body before start of the measurement processing.
Figure 9B:
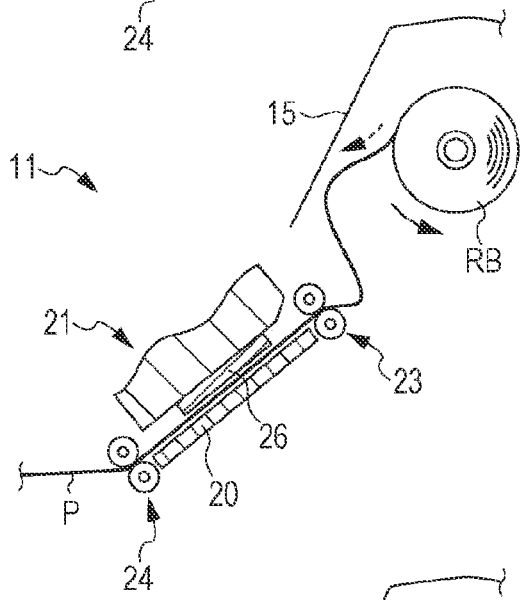
FIG. 9B is a schematic diagram showing movement of the paper of the roll body when the feed motor stops and the roll-out motor rotates in the measurement processing.

As shown in FIG. 9A, in a state before performing the measurement processing, the paper P is drawn from the roll body RB, and the paper P is transported to the support table 20. At this time, no slack occurs in the paper P drawn from the roll body RB.

Figures 8A, 8B, 8C:
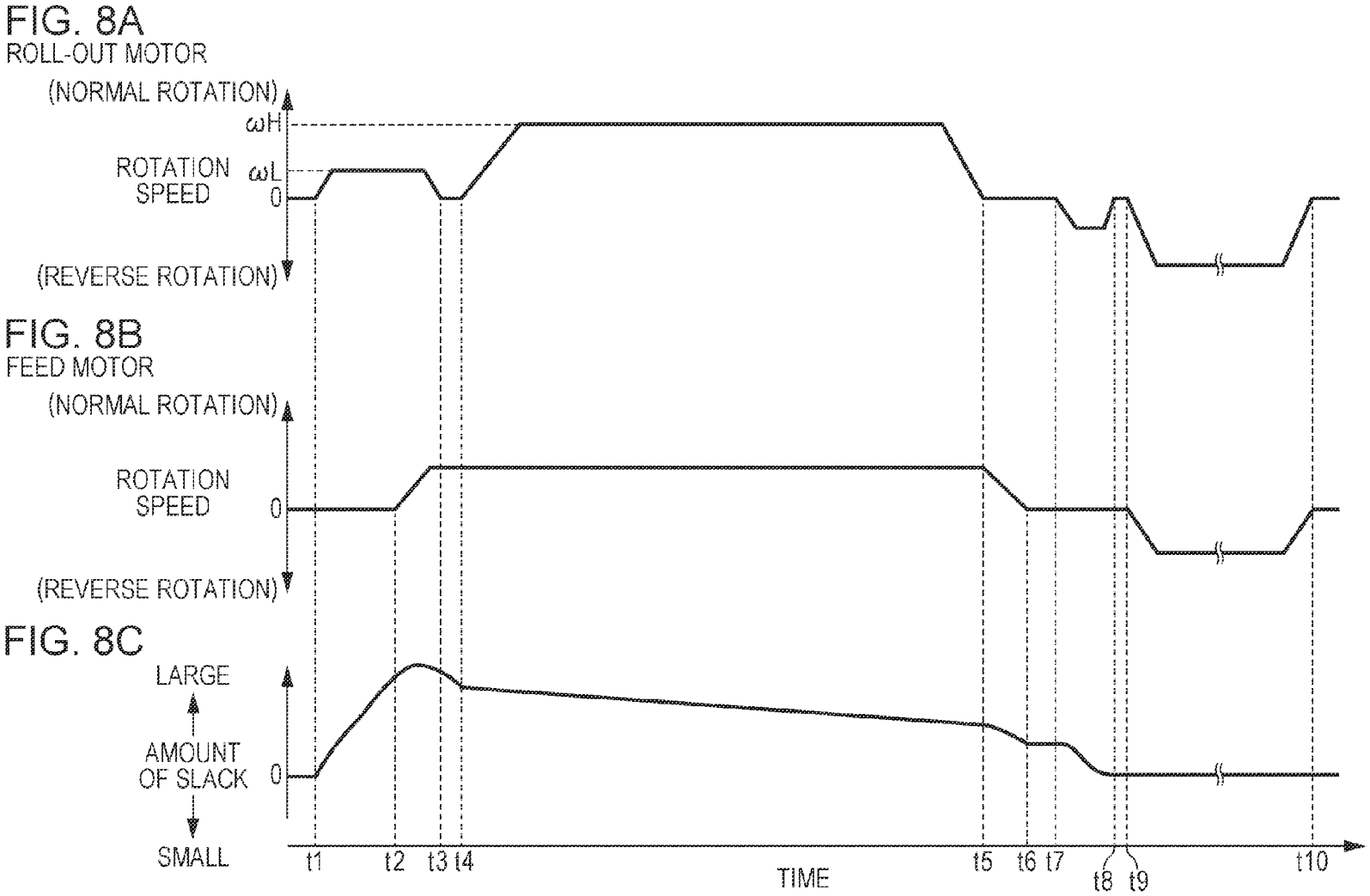
FIG. 8A is a time chart showing an operating state of the roll-out motor in the measurement processing.
FIG. 8B is a time chart showing an operating state of a feed motor in the measurement processing.
FIG. 8C is a graph showing an amount of slack of paper in the measurement processing.
Figure 9C:
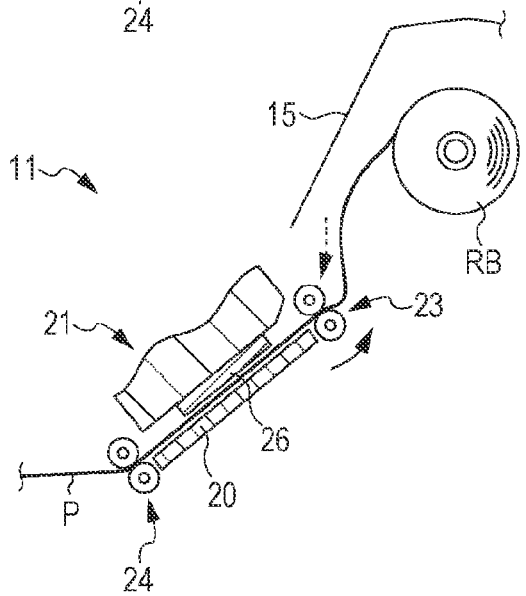
FIG. 9C is a schematic diagram showing movement of the paper of the roll body when the feed motor rotates and the roll-out motor stops in the measurement processing.

As shown in FIG. 8A, the control apparatus 40 starts execution of the measurement processing at time t1. In a period from time t1 to time t3, the control apparatus rotates the roll body RB by a quarter turn while the roll-out motor 28 is in the state of low speed ωL and thereafter stops the roll-out motor 28. On the other hand, as shown in FIG. 8B, the feed motor 31 stops in a period from time t1 to time t2 before time t3. Therefore, while the roll body RB rotates normally as indicated by a thick arrow in FIG. 9B, the paper P between the roll body RB and the feed roller pair 23 is not transported to the support table 20, and thereby the paper A drawn from the roll body RB slacks toward the opening/closing cover 15 as indicated by a dashed line arrow. In a period from time t1 to time t2, as shown in FIG. 8C, the amount of slack of the paper P drawn from the roll body RB increases as the time elapses. At time t2, as shown in FIG. 8B, the control apparatus 40 drives the feed motor 31 at a predetermined speed. Thereby, as indicated by a dashed line arrow in FIG. 9C, the paper P between the roll body RB and the feed roller pair 23 is transported toward the support table 20. Thereby, as shown in FIG. 8C, the increase of the amount of slack of the paper P decreases as the time elapses from time t2, and the drive of the roll-out motor 28 is stopped from time t3, so that the amount of slack of the paper P decreases. Therefore, as shown in FIG. 9C, the slack of the paper P decreases.

As shown in FIG. 8A, the control apparatus 40 drives the roll-out motor 28 in the state of high speed ωH at time t4. In a period from time t4 to time t5, the control apparatus 40 rotates the roll body RB by a quarter turn while the roll-out motor 28 is in the state of high speed ωH and thereafter stops the roll-out motor 28. On the other hand, as shown in FIG. 8B, the feed motor 31 rotates at a predetermined speed in a period from time t2 to time t6 after time t5. At this time, as shown in FIG. 8C, the amount of slack of the paper P gradually decreases as the time elapses. In other words, the transport speed at which the feed roller pair 23 transports the paper P to the downstream side in the transport direction is slightly faster than the transport speed at which the paper P is transported by the roll-out motor 28 from the roll body RB to the feed roller pair 23.

As described above, in the measurement processing, the amount of rotation when the roll-out motor 28 rotates the roll body RB in the state of low speed ωL is smaller than one rotation, so that the processing time of the measurement processing is shorter than that of a case in which the roll body RB is rotated by one turn at high speed and at low speed respectively as in ordinary measurement processing.

Subsequently, the printing apparatus 11 performs the slack removal processing in a period from t7 to t8. In the slack removal processing, the control apparatus 40 drives the roll-out motor 28 so that the roll body RB rotates in a reverse direction while the feed motor 31 is stopped. In this processing, for example, the same processing as roll motor slack removal processing described in JP-A-2011-46172 is performed.

Finally, the printing apparatus 11 performs the tensile force adjustment processing in a period from t9 to t10. The control apparatus 40 sets a DUTY value obtained by subtracting a correction value from the DUTY value of the feed motor 31 used when the paper P is transported at a predetermined speed as the DUTY value of the roll-out motor 28. Thereby, the rotation speed of the roll-out motor 28 becomes slower than the rotation speed of the feed motor 31. Thereby, the length of transport of the paper P of the roll body RB is smaller than the length of transport of the paper P transported by the feed motor 31, so that the tensile force F is applied to the paper P between the roll body RB and the feed roller pair 23 in the transport path. Then, ink is ejected by the print head 26 to the paper P transported to the support table 20 by the feed roller pair 23 and printing is performed on the paper P.

According to the printing apparatus 11 of the embodiment, it is possible to obtain the effects described below.

(1) In the measurement processing, the control apparatus 40 calculates the rotation load TiL when the roll body RB is rotated by one turn while the roll-out motor 28 is in the state of low speed ωL based on the rotation load TiH when the roll body RB is rotated by one turn while the roll-out motor 28 is in the state of high speed ωH. Therefore, in the measurement processing, the control apparatus 40 need not rotate the roll body RB by two turns, so that it is possible to reduce the time of the measurement processing.

(2) In the measurement processing, the rotation angle range R1 of the roll body RB in a period while the roll-out motor 28 is in the state of low speed ωL is smaller than the rotation angle range (360°) of the roll body RB in a period while the roll-out motor 28 is in the state of high speed ωH. Therefore, it is possible to reduce the rotation angle range of the roll body RB at the low speed ωL of the roll-out motor 28 which takes a long time to rotate the roll body RB by one turn, so that it is possible to further reduce the time of the measurement processing.

(3) In the measurement processing, the roll-out motor 28 rotates the roll body RB by one turn at the high speed ωH, so that it is possible to more accurately grasp the variation of the rotation load of the roll-out motor 28 than when measuring the rotation load of the roll-out motor 28 while the roll body RB rotates by less than one turn. Therefore, it is possible to accurately control the tensile force applied to the paper P to the tensile force F that is set in advance.

(4) In the measurement processing, the roll-out motor 28 rotates at the high speed ωH which is the fastest rotation speed during printing, and the roll-out motor 28 rotates at the low speed ωL which is the slowest rotation speed during printing. Therefore, it is possible to obtain the load-speed relationship in the largest speed range during printing. Therefore, it is possible to calculate the DUTY value Dx with respect to a predetermined speed wn of the roll-out motor 28 based on the load-speed relationship.

(5) The control apparatus 40 performs determination processing that determines whether to perform the measurement processing or the simple measurement processing. Thereby, as compared with a case in which the measurement processing is performed every time the roll body RB is set in the paper feed unit 14, when the simple measurement processing is performed, the time from when the roll body RB is set in the paper feed unit 14 to when printing is performed on the paper P is reduced.

(6) In the measurement processing, the rotation speed of the feed motor 31 is set so that the transport speed of the paper P transported by the feed roller pair 23 rotated by the feed motor 31 is higher than the transport speed of the paper P transported by the roll-out motor 28 at the high speed ωH. Thereby, the amount of slack of the paper P gradually decreases in the period of the measurement processing. Therefore, it is possible to reduce the amount of slack when the slack removal processing is started, so that it is possible to reduce the time taken to perform the slack removal processing.

(7) Both ends of the roll body RB in a shaft direction are supported by a pair of roll body support units 16, so that a support shaft (not shown in the drawings) is inserted through a hollow portion of the roll body RB over the entire roll body RB in the shaft direction. Therefore, it is possible for a user to easily set the roll body RB in the paper feed unit 14 as compared with a configuration in which the roll body RB is supported by the paper feed unit 14.

However, in the case of a support structure of the roll body RB by a pair of roll body support units 16, a central portion of the roll body RB in the shaft direction is not supported by the roll body support units 16, so that a central portion of the roll body RB may sag down by the weight of itself. Thereby, there is a case in which the rotation load applied to the roll-out motor 28 varies in accordance with the rotation of the roll body RB.

On the other hand, in the embodiment, the measurement processing is performed after the roll body RB is set in the paper feed unit 14, and thereby the rotation load applied to the roll-out motor 28 in accordance with the rotation of the roll body RB is obtained. Therefore, the roll-out motor 28 is controlled based on the rotation load, so that it is possible to control the tensile force applied to the paper P to the tensile force F that is set in advance. Therefore, it is possible to easily set the roll body RB in the paper feed unit 14 and to suppress variation of the tensile force applied to the paper P.

(8) In the measurement processing, the control apparatus 40 drives the feed motor 31 and transports the paper P onto the support table 20 after a predetermined time (time t2 in FIGS. 8A to 8C) from when the roll-out motor 28 starts rotation at the low speed ωL (time t1 in FIGS. 8A to 8C). Therefore, the amount of slack of the paper P drawn from the roll body RB decreases, so that the paper P is restrained from being damaged by coming into contact with the opening/closing cover 15.

The embodiment may be changed into other embodiments as described below.

In the measurement processing of the embodiment described above, the control apparatus 40 may rotate the roll body RB by one turn while the roll-out motor 28 is in the state of high speed ωH and thereafter rotate the roll body RB by a quarter turn while the roll-out motor 28 is in the state of low speed ωL.

In the measurement processing of the embodiment described above, the control apparatus 40 may rotate the roll body RB by one turn while the roll-out motor 28 is in the state of low speed ωL and rotate the roll body RB by a quarter turn while the roll-out motor 28 is in the state of high speed ωH. In this case, the control apparatus 40 calculates the average value aveTiH of the rotation loads TiH in a period while the roll-out motor 28 is in the state of high speed ωH based on the following expression instead of the aforementioned expression (4) for calculating the average value aveTiL of the rotation loads TiL in a period while the roll-out motor 28 is in the state of low speed ωL.

$$aveTiH=aveTiHp+(aveTiL-aveTiLp) \quad (8)$$

In the measurement processing of the embodiment described above, the control apparatus 40 may set the rotation angle range R1 in a period while the roll-out motor 28 is in the state of low speed ωL to a rotation angle range (for example, 100° or 80°) different from 90°. In other words, the control apparatus 40 may set the rotation angle range in a period while the roll-out motor 28 is in the state of low speed ωL to a rotation angle range greater than 90° within a range in which the time taken to perform the measurement processing is shorter than the time taken to perform ordinary measurement processing. Further, the control apparatus 40 may set the rotation angle range in a period while the roll-out motor 28 is in the state of low speed ωL to a rotation angle range smaller than 90° within a range in which the average value aveTiL of the rotation loads TiL in a period while the roll-out motor 28 is in the state of low speed ωL can be calculated.

In the measurement processing of the embodiment described above, the control apparatus 40 may set the rotation angle range in a period while the roll-out motor 28 is in the state of high speed ωH to a rotation angle range (for example, 380°) different from 360°. In other words, the control apparatus 40 may set the rotation angle range in a period while the roll-out motor 28 is in the state of high speed ωH to a rotation angle range greater than or equal to 360° within a range in which the time taken to perform the measurement processing is shorter than the time taken to perform ordinary measurement processing.

In the measurement processing of the embodiment described above, the feed motor 31 is rotated at a predetermined speed after the roll-out motor 28 starts rotating at the low speed ωL (time t1 in FIGS. 8A to 8C). However, the control of the feed motor 31 may be changed as follows.

The control apparatus 40 stops the feed motor 31 when the slack detection unit 27 is in an off state, that is, when the amount of slack of the paper P is smaller than a threshold value, and the control apparatus 40 drives the feed motor 31 when the slack detection unit 27 is in an on state, that is, when the amount of slack of the paper P is greater than or equal to the threshold value. Thereby, the amount of slack of the paper P is adjusted to be within a predetermined range.

In the measurement processing of the embodiment described above, the timing to drive the feed motor 31 (time t2 in FIGS. 8A to 8C) after the roll-out motor 28 starts rotating at the low speed ωL (time t1 in FIGS. 8A to 8C) may be changed by a user by operating the operation unit 17.

In the measurement processing of the embodiment described above, the timing to drive the feed motor 31 (time t2 in FIGS. 8A to 8C) after the roll-out motor 28 starts rotating at the low speed ωL (time t1 in FIGS. 8A to 8C) may be changed according to the radius r of the roll body RB. For example, as the radius r of the roll body RB decreases, the timing to drive the feed motor 31 is advanced.

In the measurement processing of the embodiment described above, the control apparatus 40 may increase the rotation speed of the feed motor 31 as the radius r of the roll body RB decreases. Thereby, the amount of slack of the paper P is restrained from increasing excessively.

In the measurement processing of the embodiment described above, the roll-out motor 28 may rotate at the high speed ωH immediately after rotating at the low speed ωL without stopping. Thereby, it is possible to further reduce the processing time of the measurement processing.

In the simple measurement processing of the embodiment described above, the roll body RB may be rotated by a quarter turn or may be rotated by a half turn. In other words, the rotation angle range of the roll body RB measured in the simple measurement processing may be a rotation angle range of the roll body RB where the simple measurement processing can be completed in a period of time shorter than that in the measurement processing and a relationship between the rotation load of the roll-out motor 28 and the rotation speed of the roll-out motor 28 can be obtained.

In the embodiment described above, the control apparatus 40 may omit the determination processing. In this case, the control apparatus 40 performs the measurement processing when the roll body RB is set in the paper feed unit 14.

In the embodiment described above, a noncontact type slack detection unit may be used instead of the contact type slack detection unit 27. As an example of the noncontact type slack detection unit, there is an optical sensor that emits light to the paper P drawn from the roll body RB, receives reflected light, and detects the position of the paper P that varies depending on the presence or absence of slack by measuring the time from when the light is emitted to when the reflected light is received.

In the embodiment described above, the slack detection unit 27 may be omitted.

In the embodiment described above, the printing apparatus 11 is embodied into a serial printer. However, the printing apparatus 11 may be a line printer or a page printer.

In the embodiment described above, the printing apparatus 11 may be a liquid ejecting apparatus that ejects or discharges liquid other than ink. The shapes of the liquid discharged from the liquid ejecting apparatus as a very small amount of droplet include a grain shape, a tear shape, and a shape leaving a trail like a string. The liquid here may be a material that can be ejected from the liquid ejecting apparatus. For example, the liquid may be any material in a liquid phase, including fluid bodies such as a liquid body with high viscosity or low viscosity, sol, gel water, other inorganic solvent, organic solvent, liquid solution, liquid resin, and liquid metal (metallic melt). Further, the liquid includes not only liquid as a state of a material, but also a solvent in which particles of functional materials formed of solid materials such as pigment and metallic particles are dissolved, dispersed, or mixed. Typical examples of the liquid include ink as described in the above embodiment and liquid crystal. Here, the ink includes various liquid compositions such as general water based ink and oil based ink, gel ink, and hot melt ink.

The entire disclosure of Japanese Patent Application No. 2014-164741, filed Aug. 13, 2014 is expressly incorporated by reference herein.

What is claimed is:

1. A printing apparatus comprising:

a roll body support unit that supports a roll body formed by lap-winding a print medium;

a drive unit that rotates the roll body supported by the roll body support unit; and a load measuring unit that measures a change of a rotation load of the roll body when the roll body is rotated at a first rotation speed and a change of a rotation load of the roll body when the roll body is rotated at a second rotation speed different from the first rotation speed, wherein a rotation angle range of the roll body rotated at the second rotation speed is greater than a rotation angle range of the roll body rotated at the first rotation speed, and at least a part of the rotation angle range of the roll body rotated at the first rotation speed overlaps with the rotation angle range of the roll body rotated at the second rotation speed.

2. The printing apparatus according to claim 1, wherein the second rotation speed is faster than the first rotation speed.

3. The printing apparatus according to claim 1, wherein the load measuring unit measures a change of the rotation load of the roll body over one rotation of the roll body rotated at the second rotation speed.

4. The printing apparatus according to claim 1, wherein the load measuring unit measures a change of the rotation load of the roll body over a quarter rotation of the roll body rotated at the first rotation speed.

5. The printing apparatus according to claim 1, wherein the first rotation speed is a slowest speed during printing of the print medium, and the second rotation speed is a fastest speed during printing of the print medium.

6. The printing apparatus according to claim 1, further comprising:

a slack detection unit that detects a slack state of the print medium drawn from the roll body.

* * * * *